US006298511B1

(12) United States Patent
Collymore

(10) Patent No.: US 6,298,511 B1
(45) Date of Patent: Oct. 9, 2001

(54) ARTICULATED AIR MATTRESS

(76) Inventor: Deborah D. Collymore, 1438 Joyce Dr., Flossmoor, IL (US) 60422

( * ) Notice: Subject to any disclaimer, the term of this patent is extended or adjusted under 35 U.S.C. 154(b) by 0 days.

(21) Appl. No.: 09/564,719

(22) Filed: May 4, 2000

(51) Int. Cl.[7] ..... A61G 7/08
(52) U.S. Cl. ..... 5/715; 5/615; 5/81.1 R
(58) Field of Search ..... 5/715, 615, 655.3, 5/81.1 R, 660, 634, 632, 81.1 T

(56) References Cited

U.S. PATENT DOCUMENTS

| | | | | |
|---|---|---|---|---|
| 3,485,240 | * | 12/1969 | Fountain | 5/715 |
| 3,875,599 | | 4/1975 | Mracek et al. . | |
| 3,935,604 | | 2/1976 | Collins . | |
| 4,941,221 | * | 7/1990 | Kanzler | 5/715 |
| 4,977,629 | * | 12/1990 | Jones | 5/615 |
| 5,070,559 | | 12/1991 | Pettifer . | |
| 5,072,468 | | 12/1991 | Hagopian . | |
| 5,092,007 | * | 3/1992 | Hasty | 5/715 |
| 5,103,519 | | 4/1992 | Hasty . | |
| 5,375,273 | * | 12/1994 | Bondine et al. | 5/715 |
| 5,560,057 | | 10/1996 | Madsen et al. . | |
| 6,154,900 | * | 12/2000 | Shaw | 5/81.1 R |

* cited by examiner

*Primary Examiner*—B. Dayoan
*Assistant Examiner*—Fredrick Conley

(57) ABSTRACT

A articulated air mattress for maneuvering bed-ridden patients. The articulated air mattress includes a base portion. The base portion has a top wall, a bottom wall, and a peripheral side wall. At least one lifting member comprises a top surface, and a bottom surface. A perimeter wall is integrally coupled to and extends between the top and bottom surfaces. The lifting member is generally wedge-shaped such that the bottom surface and the top surface each have a first edge positioned generally adjacent to each other and a second edge spaced from each other. The first edges define a proximal edge and the second edges defined a distal edge. The lifting member is comprises of a flexible and air impervious material. The lifting member has an opening therein adapted for receiving and expelling air. The opening is adapted to be selectively opened and closed. The proximal edge is hingedly coupled to the top wall. Wherein the lifting member is inflated such that a top surface of the lifting member is in an angular relationship with the base portion.

7 Claims, 1 Drawing Sheet

ARTICULATED AIR MATTRESS

BACKGROUND OF THE INVENTION

1. Field of the Invention

The present invention relates to air mattresses and more particularly pertains to a new articulated air mattress for maneuvering bed-ridden patients.

2. Description of the Prior Art

The use of air mattresses is known in the prior art. More specifically, air mattresses heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,935,604; U.S. Pat. No. 3,875,599; U.S. Pat. No. 5,072,468; U.S. Pat. No. 5,070,599; U.S. Pat. No. 5,103,519; and U.S. Pat. No. 5,560,057.

While these devices fulfill their respective, particular objectives and requirements, the aforementioned patents do not disclose a new articulated air mattress. The inventive device includes a base portion. The base portion has a top wall, a bottom wall, and a peripheral side wall. At least one lifting member comprises a top surface, and a bottom surface. A perimeter wall is integrally coupled to and extends between the top and bottom surfaces. The lifting member is generally wedge-shaped such that the bottom surface and the top surface each have a first edge positioned generally adjacent to each other and a second edge spaced from each other. The first edges define a proximal edge and the second edges defined a distal edge. The lifting member is comprises of a flexible and air impervious material. The lifting member has an opening therein adapted for receiving and expelling air. The opening is adapted to be selectively opened and closed. The proximal edge is hingedly coupled to the top wall. Wherein the lifting member is inflated such that a top surface of the lifting member is in an angular relationship with the base portion.

In these respects, the articulated air mattress according to the present invention substantially departs from the conventional concepts and designs of the prior art, and in so doing provides an apparatus primarily developed for the purpose of maneuvering bed-ridden patients.

SUMMARY OF THE INVENTION

In view of the foregoing disadvantages inherent in the known types of air mattresses now present in the prior art, the present invention provides a new articulated air mattress construction wherein the same can be utilized for maneuvering bed-ridden patients.

The general purpose of the present invention, which will be described subsequently in greater detail, is to provide a new articulated air mattress apparatus and method which has many of the advantages of the air mattresses mentioned heretofore and many novel features that result in a new articulated air mattress which is not anticipated, rendered obvious, suggested, or even implied by any of the prior art air mattresses, either alone or in any combination thereof.

To attain this, the present invention generally comprises a base portion. The base portion has a top wall, a bottom wall, and a peripheral side wall. At least one lifting member comprises a top surface, and a bottom surface. A perimeter wall is integrally coupled to and extends between the top and bottom surfaces. The lifting member is generally wedge-shaped such that the bottom surface and the top surface each have a first edge positioned generally adjacent to each other and a second edge spaced from each other. The first edges define a proximal edge and the second edges defined a distal edge. The lifting member is comprises of a flexible and air impervious material. The lifting member has an opening therein adapted for receiving and expelling air. The opening is adapted to be selectively opened and closed. The proximal edge is hingedly coupled to the top wall. Wherein the lifting member is inflated such that a top surface of the lifting member is in an angular relationship with the base portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new articulated air mattress apparatus and method which has many of the advantages of the air mattresses mentioned heretofore and many novel features that result in a new articulated air mattress which is not anticipated, rendered obvious, suggested, or even implied by any of the prior art air mattresses, either alone or in any combination thereof.

It is another object of the present invention to provide a new articulated air mattress which may be easily and efficiently manufactured and marketed.

It is a further object of the present invention to provide a new articulated air mattress which is of a durable and reliable construction.

An even further object of the present invention is to provide a new articulated air mattress which is susceptible of a low cost of manufacture with regard to both materials and labor, and which accordingly is then susceptible of low prices of sale to the consuming public, thereby making such articulated air mattress economically available to the buying public.

Still yet another object of the present invention is to provide a new articulated air mattress which provides in the apparatuses and methods of the prior art some of the advantages thereof, while simultaneously overcoming some of the disadvantages normally associated therewith.

Still another object of the present invention is to provide a new articulated air mattress for maneuvering bed-ridden patients.

Yet another object of the present invention is to provide a new articulated air mattress which includes a base portion. The base portion has a top wall, a bottom wall, and a peripheral side wall. At least one lifting member comprises a top surface, and a bottom surface. A perimeter wall is integrally coupled to and extends between the top and bottom surfaces. The lifting member is generally wedge-shaped such that the bottom surface and the top surface each have a first edge positioned generally adjacent to each other and a second edge spaced from each other. The first edges define a proximal edge and the second edges defined a distal edge. The lifting member is comprises of a flexible and air impervious material. The lifting member has an opening therein adapted for receiving and expelling air. The opening is adapted to be selectively opened and closed. The proximal edge is hingedly coupled to the top wall. Wherein the lifting member is inflated such that a top surface of the lifting member is in an angular relationship with the base portion.

Still yet another object of the present invention is to provide a new articulated air mattress that aid in the turning over of bed-ridden individuals in a steady and comfortable way to prevent further injury of patient.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
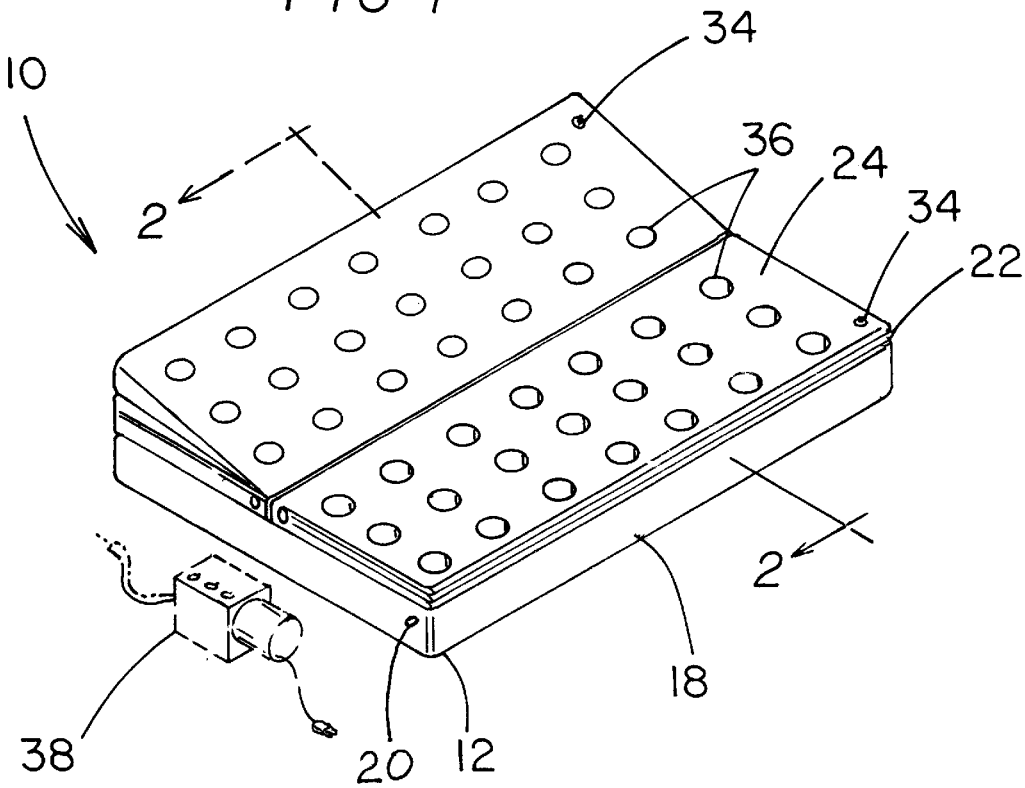
FIG. 1 is a schematic perspective view of a new articulated air mattress according to the present invention.
Figure 2:
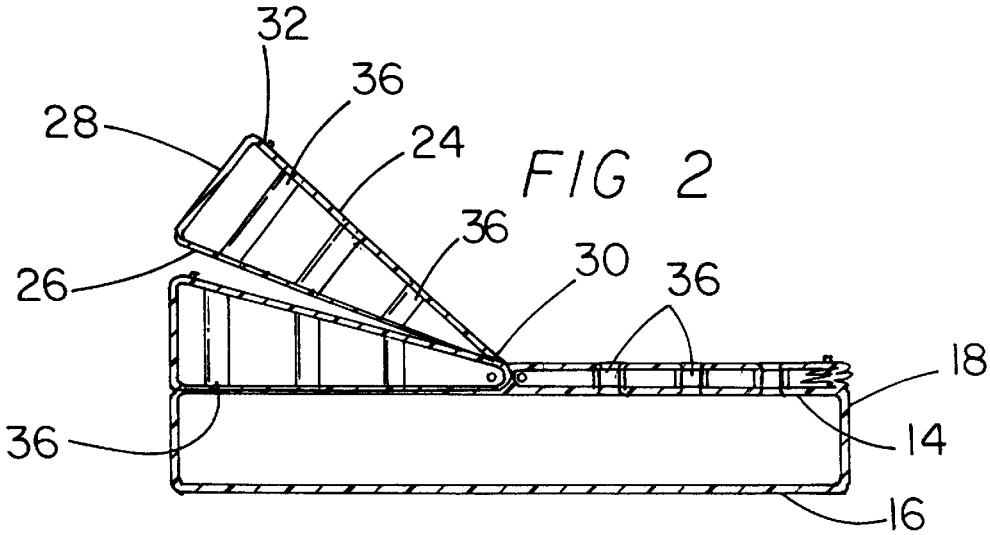
FIG. 2 is a schematic side cross-sectional view taken along line 2—2 of the present invention.

With reference now to the drawings, and in particular to FIGS. 1 through 2 thereof, a new articulated air mattress embodying the principles and concepts of the present invention and generally designated by the reference numeral 10 will be described.

As best illustrated in FIGS. 1 through 2, the articulated air mattress 10 generally comprises a base portion 12. The base portion 12 has a top wall 14, a bottom wall 16, and a peripheral side wall 18. The base portion 12 is generally hollow. The base portion 12 comprises a flexible and air impervious material such as vinyl though any conventional air mattress material may be used. The peripheral wall 18 has an aperture 20 therein adapted for receiving and expelling air. The aperture 20 is adapted to be selectively opened and closed. The top 14 and bottom walls 16 have a generally rectangular shape.

A plurality of lifting members 22 each have a top surface 24, and a bottom surface 26. A perimeter wall 28 is coupled to and extends between the top 24 and bottom 26 surfaces. The lifting member 22 is generally hollow. The lifting member 22 is generally wedge-shaped such that the bottom surface and the top surface each have a first edge 30 positioned generally adjacent to each other and a second, opposite, edge 32 spaced from each other. Wherein the first edges 30 define a proximal edge and the second edges 32 defined a distal edge. The lifting member 22 is comprised of a flexible and air impervious material. The top 24 and bottom 26 surfaces each has an opening 34 therein adapted for receiving and expelling air. The openings 34 are adapted to be selectively opened and closed. The top surface 24 has a length generally equal to a length of the top wall 14 and a width generally equal to one-half a length of the top wall. The proximal edge 30 is hingedly coupled to the top wall 14 by a hinge means. The proximal edge 30 is generally aligned with a longitudinal axis of the base portion 12 such that the lifting member 22 substantially covers one-half of the base portion 12.

A plurality of tubular members 36 each extends through the top 24 and bottom 26 surfaces of the lifting members 22 such that air may travel through the tubular members 36. This keeps the user cooler.

The plurality of lifting members 22 is preferably three lifting members each hingedly coupled to the base portion 12.

In use, an air compressor 38 may be used to inflate the base portion and the individual lifting members. One of the lifting members 22 is inflated such that a top surface 24 of the lifting member is in an angular relationship with the base portion 12. This allows a nurse or other health care personnel to roll the patient over to prevent bed sores and other maladies caused by lying in one position for a long duration of time.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An articulated air mattress comprising:

a base portion, said base portion having a top wall, a bottom wall, and a peripheral side wall;

at least one lifting member comprising;

a top surface, and a bottom surface, a perimeter wall being coupled to and extending between said top and bottom surfaces, said lifting member being generally wedge-shaped such that said bottom surface and said top surface each have a first edge positioned generally adjacent to each other and a second edge spaced from each other, wherein said first edges define a proximal edge and said second edges defined a distal edge, said lifting member comprising a flexible and air impervious material, said lifting member having an opening therein adapted for receiving and expelling air, said opening being adapted to selectively open and close, said proximal edge being hingedly coupled to said top wall;

wherein said lifting member is inflated such that a top surface of said lifting member is in an angular relationship with said base portion.

2. The articulated air mattress as in claim 1, wherein said base portion further comprises:

said base portion comprising a flexible and air impervious material, said peripheral wall having an aperture therein adapted for receiving and expelling air, said aperture being adapted to being selectively opened and closed, said top and bottom walls having a generally rectangular shape.

3. The air mattress as in claim 1, wherein said lifting member comprises a plurality of lifting members hingedly coupled to said base portion.

4. The articulated air mattress as in claim 2, wherein said lifting member further comprises:

said top surface having a length generally equal to a length of said top wall and a width generally equal to one-half a length of said top wall, said proximal edge being hingedly coupled to said top wall, said proximal edge being generally aligned with a longitudinal axis of said base portion such that said lifting, member substantially covers one-half of said base portion.

5. The articulated air mattress as in claim 4, further comprising a second lifting member, said second lifting member having a proximal edge coupled to said top portion, said proximal edge of said second lifting member being positioned generally adjacent to said proximal edge of the first lifting member.

6. The articulated air mattress as in claim 5, said lifting members each further comprising:

a plurality of tubular members, each of said tubular members extending through said top and bottom surfaces of said lifting members such that air may travel through said tubular members.

7. An articulated air mattress comprising:

a base portion, said base portion having a top wall, a bottom wall, and a peripheral side wall, said base portion being generally hollow, said base portion comprising a flexible and air impervious material, said peripheral wall having an aperture therein adapted for receiving and expelling air, said aperture being adapted to being selectively opened and closed, said top and bottom walls having a generally rectangular shape;

a plurality of lifting members comprising;

a top surface, and a bottom surface, a perimeter wall being coupled to and extending between said top and bottom surfaces, said lifting member being generally hollow, said lifting member being generally wedge-shaped such that said bottom surface and said top surface each have a first edge positioned generally adjacent to each other and a second edge spaced from each other, wherein said first edges define a proximal edge and said second edges defined a distal edge, said lifting member comprising a flexible and air impervious material, said top and bottom surfaces each having an opening therein adapted for receiving and expelling air, said openings being adapted to being selectively opened and closed, said top surface having a length generally equal to a length of said top wall and a width generally equal to one-half a length of said top wall, said proximal edge being hingedly coupled to said top wall, said proximal edge being generally aligned with a longitudinal axis of said base portion such that said lifting member substantially covers one-half of said base portion;

a plurality of tubular members, each of said tubular members extending through said top and bottom surfaces of said lifting members such that air may travel through said tubular members;

wherein said plurality of lifting members is three lifting members each hingedly coupled to said base portion; and wherein one of said lifting members is inflated such that a top surface of said lifting member is in an angular relationship with said base portion.

* * * * *